US006323750B1

(12) United States Patent
Lampl et al.

(10) Patent No.: US 6,323,750 B1
(45) Date of Patent: Nov. 27, 2001

(54) ELECTRICAL COMPONENT WITH A SAFETY RELEASE

(75) Inventors: Ewald Lampl, Wies; Peter Nöhrer, Fernitz; Martin Schwingenschuh, Graz; Andreas Hesse, Olpe, all of (DE)

(73) Assignees: Siemens Matsushita Components GmbH & Co. KG, München; Karl Jungbecker GmbH & Co., Olpe, both of (DE)

( * ) Notice: Subject to any disclaimer, the term of this patent is extended or adjusted under 35 U.S.C. 154(b) by 0 days.

(21) Appl. No.: 09/403,711

(22) PCT Filed: Apr. 20, 1998

(86) PCT No.: PCT/DE98/01102

§ 371 Date: Oct. 25, 1999

§ 102(e) Date: Oct. 25, 1999

(87) PCT Pub. No.: WO98/49703

PCT Pub. Date: Nov. 5, 1998

(30) Foreign Application Priority Data

Apr. 25, 1997 (DE) ..... 197 17 634

(51) Int. Cl.[7] ..... H01C 7/10

(52) U.S. Cl. ..... 338/21; 337/31; 337/405; 361/104; 361/131

(58) Field of Search ..... 337/401, 404, 337/405, 407, 31; 338/21; 361/104, 131

(56) References Cited

U.S. PATENT DOCUMENTS

| | | | | |
|---|---|---|---|---|
| 2,548,491 | * | 4/1951 | Peek | 361/104 |
| 3,450,949 | * | 6/1969 | Inglis | 361/104 |
| 3,743,993 | * | 7/1973 | Alley et al. | 361/104 |
| 3,879,696 | * | 4/1975 | Imajyo et al. | 361/104 |
| 3,889,222 | * | 6/1975 | Takano et al. | 361/104 |
| 4,017,818 | | 4/1977 | Rayburn . | |
| 4,096,464 | * | 6/1978 | Dennis et al. | 361/104 |
| 4,328,387 | * | 5/1982 | Kemble | 361/104 |
| 4,661,881 | * | 4/1987 | Watson et al. | 361/104 |
| 4,728,779 | * | 3/1988 | Kotani et al. | 338/22 R |
| 4,821,010 | * | 4/1989 | Plasko | 361/104 |
| 4,973,931 | * | 11/1990 | Herbert | 337/139 |
| 5,014,036 | * | 5/1991 | Komoto | 337/407 |
| 5,193,044 | * | 3/1993 | Czerwiec | 361/104 |
| 5,198,791 | * | 3/1993 | Shibayama et al. | 337/31 |
| 5,200,875 | * | 4/1993 | Yoshilka et al. | 337/15 |
| 5,241,445 | * | 8/1993 | Karasawa | 361/104 |
| 5,561,409 | * | 10/1996 | Rapp et al. | 337/104 |
| 5,793,274 | * | 8/1998 | Kelly et al. | 337/405 |
| 5,805,070 | * | 9/1998 | Eriksson | 337/140 |
| 5,831,507 | * | 11/1998 | Kasamatsu et al. | 337/403 |

FOREIGN PATENT DOCUMENTS

| | | |
|---|---|---|
| 122 757 | 10/1976 | (DD) . |
| 25 31 438 | 7/1978 | (DE) . |
| 36 43 622 | 6/1988 | (DE) . |
| G 90 12 881.8 | 1/1991 | (DE) . |
| 37 34 214 | 11/1991 | (DE) . |
| G 93 19 287.8 | 3/1994 | (DE) . |
| 42 41 311 A1 | 6/1994 | (DE) . |
| 42 41 311 C2 | 6/1995 | (DE) . |
| 0 110 134 | 1/1988 | (EP) . |

OTHER PUBLICATIONS

Caddock Brochure, 1973.*

* cited by examiner

*Primary Examiner*—Karl D. Easthom
(74) *Attorney, Agent, or Firm*—Schiff Hardin & Waite

(57) ABSTRACT

An electrical component is installed in a plastic cup. The component has two electrical connecting lines, and a parting location that is bridged by a solder metal is arranged in one lead. In addition, a prestressed spring is arranged at the one lead for removing the lead from the parting location during melting of the solder metal as a result of an overload, so that the component is disconnected from a current source. The one lead is pinched to a thickness of 0.2–0.5 mm.

8 Claims, 1 Drawing Sheet

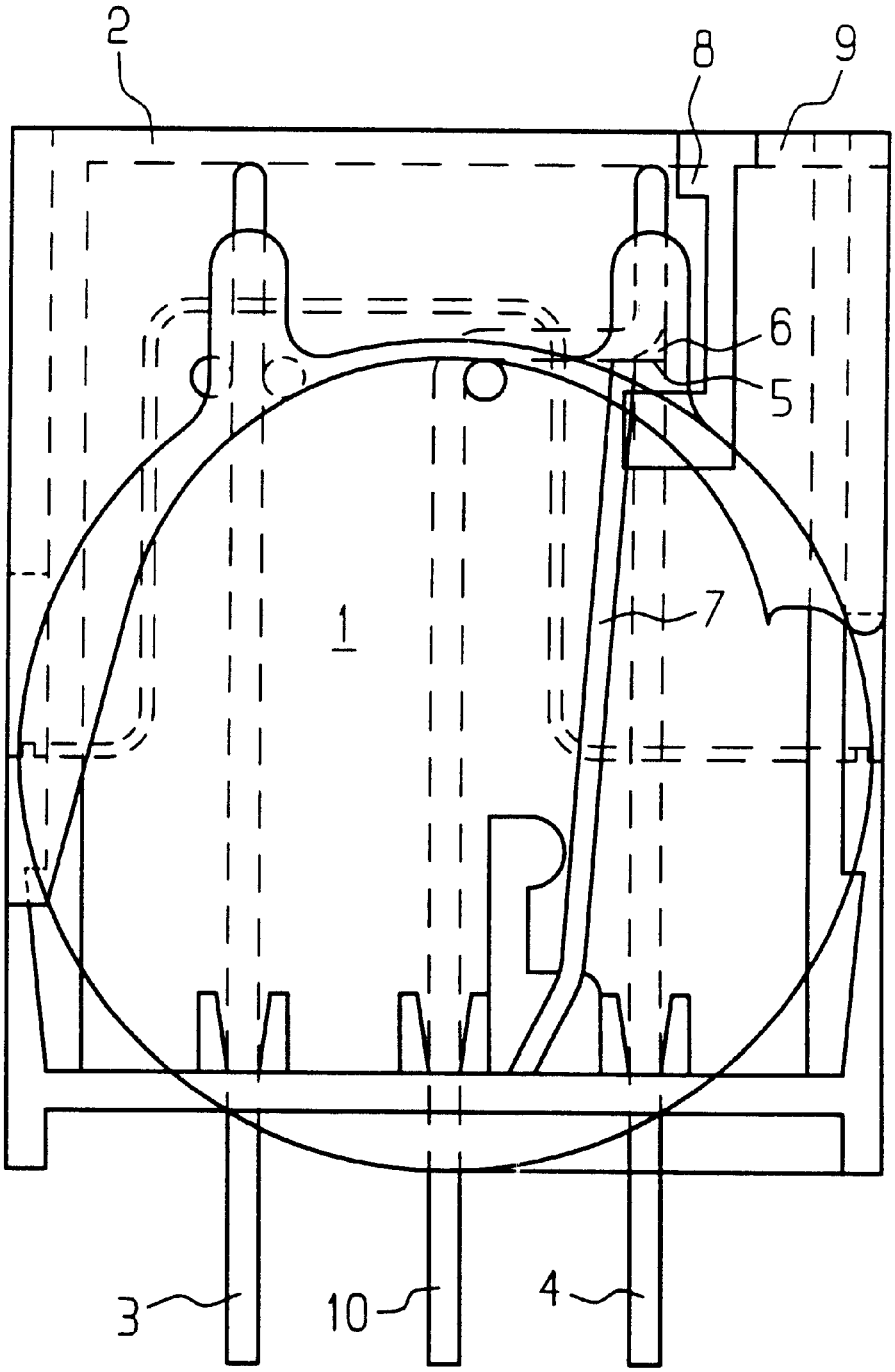
2
8
9
6
5
7
1
3
10
4

ELECTRICAL COMPONENT WITH A SAFETY RELEASE

BACKGROUND OF THE INVENTION

The invention is directed to an electrical component, particularly a varistor, that is installed in a plastic cup and has at least two electrical connecting leads, lead wires or lines, and whereby a fuse formed by a solder metal is arranged in at least one connecting line or lead, said fuse disconnecting the component from a current source given overload, whereby the solder metal bridges a separating point arranged in the lead and the lead is charged with a prestressed spring that removes the lead from the parting location given response of the fuse.

DE 42 41 311 C1 discloses such a component.

For example, DE 25 31 438 C3 also discloses that an interspace between cathode terminal and cathode contacting in a tantalum electrolyte capacitor is bridged by a metal alloy that melts given overload or incorrect polarization. The capacitor therein is surrounded with a plastic envelope that also encloses the fuse location.

A proper functioning of the fuse, however, assumes that the molten solder can escape, so that a reliable interruption of the current is assured. Since this can only ensue when the envelope bursts (crack formation), the molten solder continues to conduct the current until the envelope bursts without an interruption of the power thereby occurring.

In order to overcome these difficulties, it is therefore disclosed in EP 0 110 134 B1 that the melt fuse is surrounded by a layer of a wax-like substance whose thickness is dimensioned such that the molten metal alloy in case of a short can form molten beads in the molten wax, so that an interruption of the current can occur in time.

The described safety devices, however, assume that the component itself and the connecting wires are fixed in the plastic envelope since there would otherwise be the risk that, despite the melting of the fuse, the connecting wire would again come into contact with the component, so that a renewed current conduction could ensue.

SUMMARY OF THE INVENTION

An object of the present invention is to specify a safety release in a component of the species initially cited that allows a dependable disconnection from a power source and has an improved service life of the solder location.

This object is inventively achieved in that the lead is pinched, squeezed or flattened to a thickness of 0.2 through 0.5 mm.

The following advantages are achieved by this embodiment:

a) The lead wire receives a defined bending location.

b) The bending force is drastically reduced and a separation is still possible even with forces of approximately 0.5 N. The "flowing" which is known given soft solder under mechanical tensile stress is thus reduced and the service life of the solder location is improved.

c) The enlargement of the surface due to the pinching also effects an increased heat elimination compared to the unadulterated wire surface, the temperature stress of the parting location is thereby reduced when soldering the overall component in.

For better separation, a plastic part can be additionally arranged at the spring in the region of the fuse in a known way (DD 122 757 A), so that the protective function is improved by inserting this plastic part into the soft solder location. On the one hand, an accelerated triggering is assured because the force acts directly on the solder bead and, on the other hand, the penetrating plastic part lengthens the insulating path between the wires without deflecting these.

It is also advantageous when an additional signal line is arranged at the component, whereby a signal lamp is connected between signal and connecting line.

On the other hand, it is also possible to arrange a signal flag at the terminal side, so that the response of the thermal fuse can also be recognized through a window in the plastic cup.

The invention is explained in greater detail below with reference to the following exemplary embodiments.

BRIEF DESCRIPTION OF THE DRAWING

The FIGURE is a side view of the electrical component of the present invention.

DESCRIPTION OF THE PREFERRED EMBODIMENT

The appertaining drawing with a sole figure shows a disc-shaped component 1, for example a varistor, that is installed in a plastic cup 2. The component 1 has two electrical connecting leads or terminals 3, 4, whereby a parting or separating location 5 that is electrically conductively bridged by a solder metal 6 is arranged in the terminal lead or connecting lead 4. A spring 7 is attached to the floor of the plastic cup 2, this spring 7 pressing or engaging prestress against the upper end of the connecting lead or line 4 in the region of the parting location 5. The prestressed spring 7 assures that, when the solder metal 6 melts as a consequence of overload, the upper end of the connecting lead or line 4 is immediately pressed away from the parting location 5, so that a dependable response of the overload fuse is assured.

As a result of a suitable selection of the lead wires 3, 4 and of the melting temperature of the solder metal 6, the component 1 can also react sensitively given the occurrence of high surge currents, so that the component 1 is automatically separated from the current source when its maximum loadability is reached.

As we already mentioned above, a plastic part (not shown in the figure) can be arranged at the upper end of the prestressed spring 7, as a result whereof the described improvement of the protective function occurs.

It is also possible to arrange a signal flag 8 at the terminal lead or connecting lead 4, so that the response of the fuse can be recognized from above through a window 9 arranged in the plastic cup 2.

However, it is also possible to provide an additional signal line 10 that is in electrical contact with the connecting lead or terminal lead 4 as long as the fuse has not responded. By connecting a signal lamp between the lines 10 and 4, whether the fuse has triggered can likewise be recognized, since the circuit between the lines 10 and 4 is interrupted when the solder metal 6 melts and the lead 4 is removed.

It is advantageous when the signal line 10 is formed by a lead wire arranged at the component 1, this serving as the one electrical lead in its upper part. The lower part of the electrical lead 4 can be formed by a separate lead wire that is electrically conductively connected to the upper end of the lead wire 10 by the solder metal 6 in the region of the parting location 5. A cascadability can be undertaken by additional structural measures, for example the provision of a dovetail at the plastic housing 2, as a result whereof, for example, parallel or serial connection of components can ensue.

The described structure enables an automatic equipability of wired components, whereby the tolerance of the grid dimensions can be limited to ±0.3 mm. Further, no additional components are required, so that the component dimensions remain essentially unaltered. Such additional components, which reduce the electrical characteristics of components, were hitherto required in the prior art when a fusing of a component was desired.

The subject matter of the invention assures an automatic disconnection of overloaded components without jeopardizing devices and machines due to the overloaded components. Further, it is possible to recognize components that have failed in the systems due to the described signal devices. The components can be supplied for an automatic equipping and can be cascaded, whereby the critical component dimensions and the electrical and climactic specification values are retained.

A high-voltage tightness at 2.5 kV can be achieved with design measures, and the component can be protected against vibration and shock with mechanical support.

An arrangement is also especially advantageous wherein the electrical component 1 is tilted by 180°, so that the component body comes into contact with the fuse formed by the solder metal 6. The introduction of heat into the parting location 5 is thereby improved since a heat transfer from the component 1 via the envelope 2 to the fuse location can ensue in addition to the thermal conduction from component 1 via the connecting lead 4. In addition, the thermal resistance of the lead wire 4 is increased since the path from the motherboard to the parting location is lengthened by the tilting. This allows an optimally space-saving installation without critical enlargement of the component height.

An overlap of the lead wire 4 containing the parting location with the terminal of the component that is conducted out by 1.00–3.00 mm reduces the mechanical stress in the solder and thereby additionally enhances the dependability of the parting location.

As a result of the aforementioned features such as lead lengthening, pinching and overlap, solder materials having a low melting point (139° C.–179° C.) can be employed without reducing the service life of the parting location.

As a result of the suitable selection of wire material of the upper and lower parting location lead, the trigger properties can be set in a fine fashion; for example, switching from copper to iron or, respectively, steel-copper wire can reduce the thermal conduction such that the parting location does not undesirably open when the component is being soldered in place.

A combination, for example upper lead of copper and lower lead of steel-copper, can also be employed given a desired enhancement of the separation sensitivity. Steel-copper wires exhibit the advantage that the thermal resistance can be increased for this application without significantly reducing the electrical conductivity compared to pure copper.

We claim:

1. An electrical component being installed in a plastic cup, said component comprising:

at least a first lead wire and a second lead wire;

the first lead wire serving as a first terminal lead;

the second lead wire being formed by two portions with a first portion being directly connected to the component;

a second terminal lead being formed by two portions with a first portion of said second terminal lead being directly connected to the component and being formed by said first portion of said second lead wire, the second portion of said second terminal lead being formed by a separate lead wire, said separate lead wire being flattened to a thickness of 0.2 mm to 0.5 mm;

the first and second portions of said second terminal lead having ends abutting each other at a parting location;

a fuse being formed by solder metal bridging the parting location to electrically connect the first and second portions together; and a separate prestressed spring engaging an end of one of the first and second portions of said second terminal lead so that with a melting of the fuse material, the spring will urge the one portion away from the parting location to interrupt a current flow between the first and second portions.

2. An electrical component according to claim 1, which includes an additional signal line being arranged in the component, and a signal lamp being connected between the signal line and the second terminal lead.

3. An electrical component according to claim 1, which includes a signal flag being arranged adjacent to the parting location at the second terminal lead and the plastic cup having a window in the region of the signal flag.

4. An electrical component according to claim 1, wherein said component is a varistor.

5. An electrical component being installed in a plastic cup, said component having at least two terminal leads disposed in the cup, one of the two leads being formed by two portions having ends abutting each other at a parting location, a fuse formed by solder metal bridging the parting location to electrically connect the portions together, said one lead being flattened to a thickness of 0.2 mm to 0.5 mm, a separate prestressed spring engaging an end of one of the two portions of the one terminal lead so that with a melting of the fuse material, the spring will urge the one portion laterally away from the parting location to interrupt a current flow between the two portions.

6. An electrical component according to claim 5, wherein said component is a varistor.

7. An electrical component according to claim 5, which includes an additional signal line being arranged in the component, and a signal lamp being connected between the signal line and the one lead.

8. An electrical component according to claim 5, which includes a signal flag being arranged adjacent to the parting location at the one lead and the plastic cup having a window in the region of the signal flag.

* * * * *